US005136721A

United States Patent [19]

Farnworth et al.

[11] Patent Number: 5,136,721

[45] Date of Patent: Aug. 11, 1992

[54] NECK SEAL

[75] Inventors: Brian Farnworth; Ping Y. Sheu, both of Delta, Canada

[73] Assignee: M.E.T.A. Research, Inc., Richmond, Canada

[21] Appl. No.: 643,509

[22] Filed: Jan. 22, 1991

[51] Int. Cl.[5] ..... A41D 13/00

[52] U.S. Cl. ..... 2/2.1 R; 2/2.1 A; 2/79

[58] Field of Search ..... 2/2.1 R, 2.1 A, 79

[56] References Cited

U.S. PATENT DOCUMENTS

| | | | |
|---|---|---|---|
| 2,894,535 | 7/1959 | Hansen | 2/2.1 R |
| 3,148,742 | 6/1973 | Elfstrom et al. | 2/2.1 R |
| 3,172,126 | 3/1965 | Spano et al. | 2/2.1 R |
| 3,534,408 | 10/1970 | Fifield | 2/2.1 R |
| 3,574,862 | 4/1971 | Jones | 2/2.1 R |
| 3,731,319 | 5/1973 | O'Neill | 2/2.1 R |
| 4,015,295 | 4/1977 | Lancaster et al. | 2/2.1 R |
| 4,535,477 | 8/1985 | Musto et al. | 2/2.1 R |
| 4,547,904 | 10/1985 | Long et al. | 2/2.1 R |
| 4,862,517 | 9/1989 | Meistrell | 2/2.1 R |

FOREIGN PATENT DOCUMENTS

| | | | |
|---|---|---|---|
| 1954048 | 5/1970 | Fed. Rep. of Germany | 2/2.1 R |

*Primary Examiner*—Werner H. Schroeder
*Assistant Examiner*—Gloria Hale
*Attorney, Agent, or Firm*—Beehler & Pavitt

[57] ABSTRACT

An immersion suit having a neck band to fit around a neck and a seal at the neck. There is a thick band of closed cell foam on the interior of the neck band. The neck band and the closed cell foam can be compressed rapidly by a strap to ensure a seal when required. When a seal is not required, the foam is a relatively loose, comfortable fit around the neck of the wearer. In the preferred embodiment, the suit has an opening in the front extending to the top of the neck band to allow ingress and egress from the suit.

8 Claims, 2 Drawing Sheets

NECK SEAL

FIELD OF THE INVENTION

This invention relates to an immersion suit and, in particular, an immersion suit having an improved neck band.

DESCRIPTION OF THE PRIOR ART

An immersion suit is a suit able to provide protection to the wearer in adverse weather conditions when the wearer runs the risk of being soaked in water and, in particular, of being immersed in the sea. These suits are used by sailors, particularly fisherman and other sailors who work in small boats and are likely to encounter rough seas. In these circumstances, a sailor can be constantly wet, can be washed overboard or the boat can sink, depositing the crew in the water. In cold water, death by exposure can be rapid. Other users include pilots and helicopter passengers who can be exposed to similiar hazards.

To overcome this, immersion suits have become popular with sailors and with people working near the water or flying over water.

Typically these suits are dry suits of water-proof material sealed at the neck, wrists and ankles unless, in the last case, feet are built into the suit, as is often the case. The term "dry suits" indicates the wearer, and his underclothing, are kept dry by the suit.

The neck seals are not ideal. The means of getting into and out of the suit comprises an opening closed by a water proof fastener (usually a zip fastener), extending across the back or front of the suit, parallel to the shoulders, or diagonally, from hip to shoulder. The neck is a continuous band of an elastomeric material, relying for sealing on tightness of fit around the neck.

This is not wholly satisfactory. The suit is put on by stepping into the suit through the opening in the back or front. The upper portion of the suit is then pivoted over the head by forcing the head through the neck-band. The fastener is then closed.

There is no means of adjusting the fit of the neck. At one extreme a neck fitting may be too tight, and thus 1 uncomfortable on the wearer. At the other it may be too loose and thus leak. Even if the suit is custom made the constant forcing of the head through the neck band will eventually spoil the fit and allow the neck to leak. Further, even with a good fit, it can be uncomfortable to have a constant pressure around the neck. When working on deck, in rough weather, when working near the water, or when flying over cold water, it is strongly advisable to wear the immersion suit all the time in case an accident occurs. There is no provision in the prior art suits for changing the fit of the neck so that it can be comfortable when a seal is not required yet can be adjusted quickly and easily to become a water-tight fit, for example, upon falling into the water or moving from a protected position on a boat onto the deck.

There is therefore a need to provide a suit with a seal for the neck that is able to provide a good seal when required and yet be comfortable for the wearer when a seal is not required. The suit should be able to fit a variety of neck sizes or, at least, be able to compensate for the changes in dimensions of the suit with age or, for that matter, changes in dimensions of the wearer. The change from loose fit to sealing fit should be quick and easy to achieve.

SUMMARY OF THE INVENTION

Accordingly, the present invention is in an immersion suit having a neck band to fit around the neck and a seal at the neck and is the improvement comprising a thick band of closed cell foam on the interior of the neck band and means to compress the neck band and the foam.

In a particularly preferred embodiment the suit has an opening in the front extending to the top of the neck band to allow ingress and egress. The seal is preferably a polyvinyl chloride (PVC) closed cell foam and that same material may also be used to seal the opening at the front.

BRIEF DESCRIPTION OF THE DRAWINGS

The invention is illustrated, merely by way of example, in the drawings in which.

DESCRIPTION OF THE PREFERRED EMBODIMENT

Figure 1:
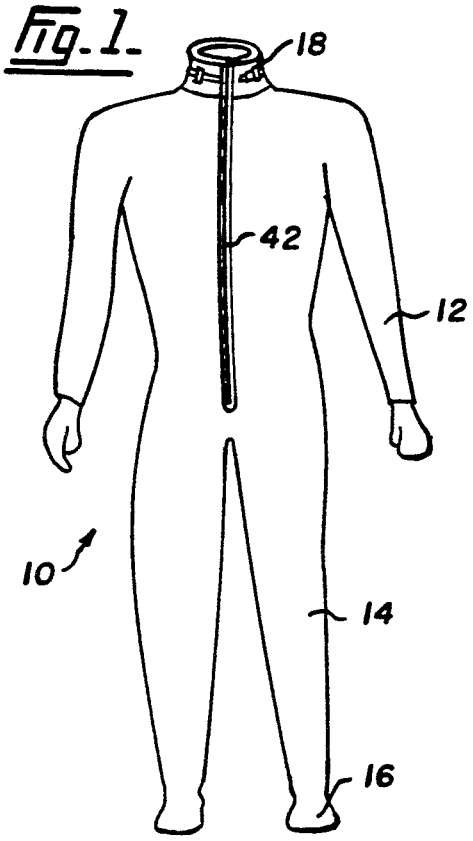
FIG. 1 is a general view of a suit according to the present invention.

The drawings show an immersion suit 10 made of any known durable, water-proof material suitable for an immersion suit. It has arms 12 and legs 14. In the illustrated embodiment feet 16 are integrally formed at the bottom of the legs 14. There is a neck band 18.

Figure 3:
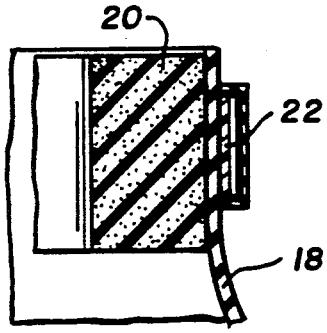
FIG. 3 is a section on the line 3—3 of FIG. 2.
Figure 2:
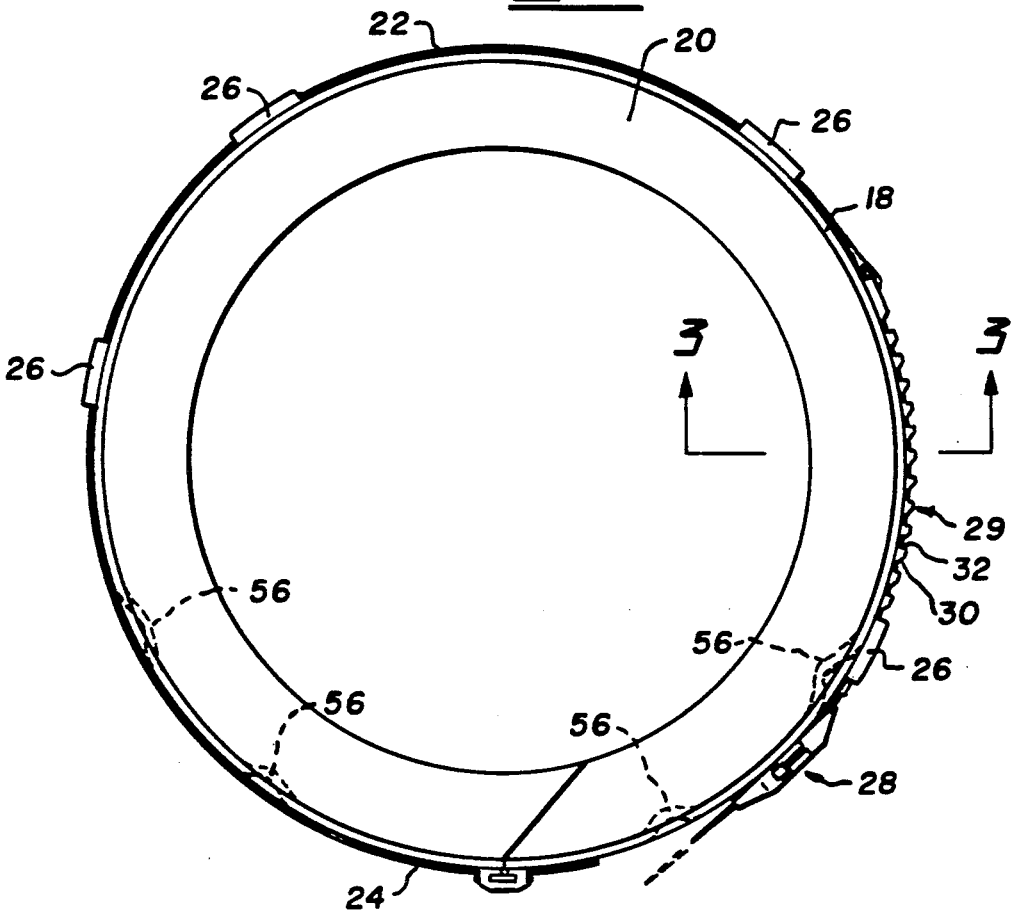
FIG. 2 shows a section of the neck of the suit of FIG. 1.

Unlike the prior art, and as shown in FIGS. 2 and 3, there is a relatively thick band of closed cell foam 20 on the interior of the neck band 18 of the suit. A PVC foam has proved suitable.

There are means to compress the neck band 18 and thus the closed cell foam 20.

Figure 4:
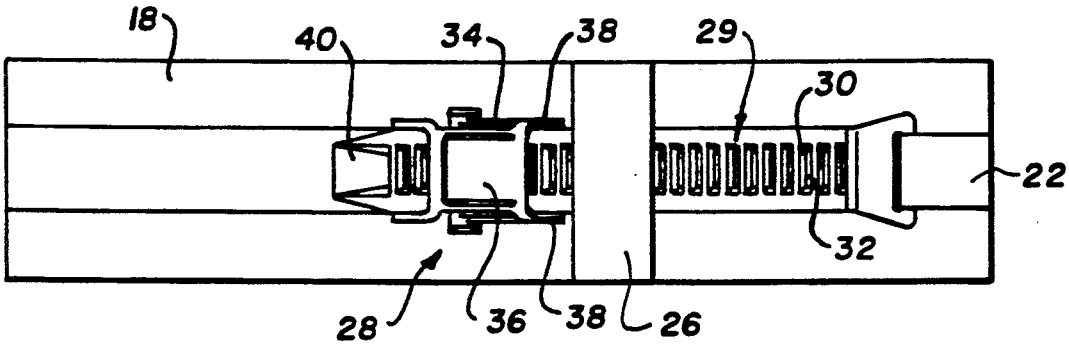
FIG. 4 is a detail of the neck of the suit of FIG. 1.

The embodiment shown in FIGS. 2 and 4 comprises a strap 22 extending from an anchor point 24, through guides 26, to a clasp 28. At one end the strap 22 has teeth 29 having an inclined surface 30 and a flat surface 32. The arrangement is shown particularly in FIG. 2.

The clasp 28 comprises a base piece 34, mounted on the neck band 18 and a pivot 36, pivotally attached to the base piece 34 at 38 and formed on its inner surface with teeth (not shown) corresponding to the teeth 29 on the strap 26. There is a handle 40 so that the pivot 36 may be pivoted about 38 to disengage the teeth in the pivot from teeth 29. Spring loading may be employed to urge the pivot 36 to the closed position, that is with two sets of the teeth engaged.

Figure 5:
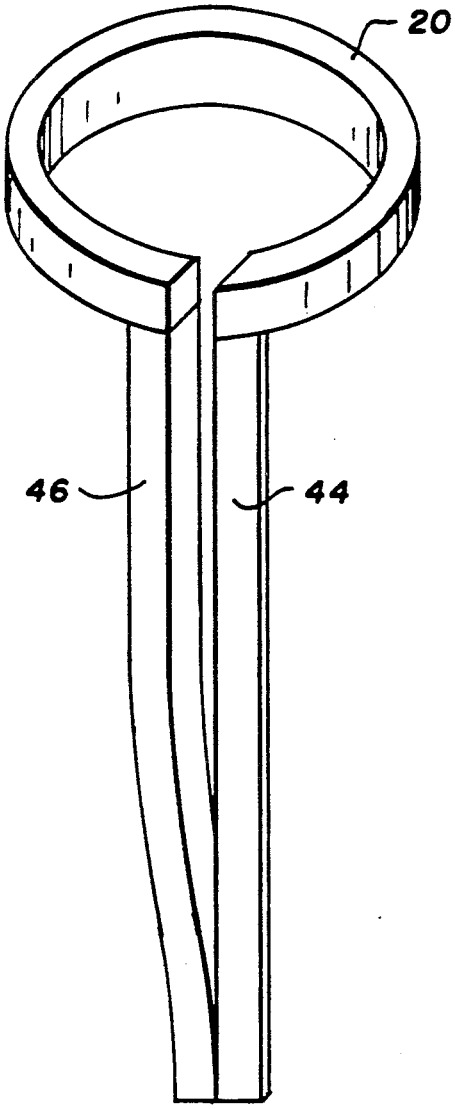
FIG. 5 shows the sealing system for the suit, both at the neck and at the front of the suit.

The suit has a closable opening 42 in the front extending to the top of the neck band 18 from adjacent the crotch of the suit to allow ingress and egress from the suit. As shown particularly in FIGS. 5 and 6, the opening is formed with a seal 44 and 46, again of a closed cell foam, for example a PVC foam. The foam seal is adhered to the front of the suit, at the sides of the opening 42, and to the neck band foam 20. The neck band foam 20 is also adhered to the interior of the neck of the suit.

Figure 6:
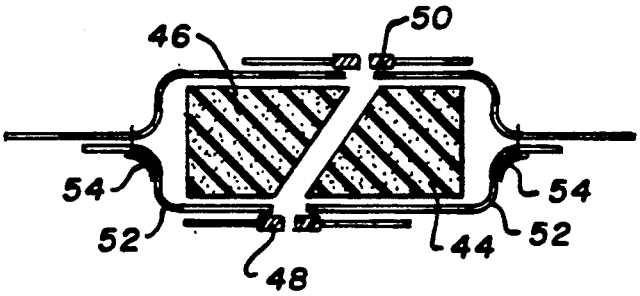
FIG. 6 shows a detail of the front seal, including means of fastening the seal.

As shown in FIG. 6 the use of seals 44 and 46 in this way permits simple slide fasteners 48 and 50, to be used on the suit.

The ends of foam 20 and seals 44 and 46 are mitred. Seals 44 and 46 allow the wearer to zip up the inner slide fastener 48 which brings together loosely the mitred surfaces of the seals 44 and 46 and the mitred ends of the foam 20. The external slide fastener 50 then closes the suit and consolidates the seal.

The compression of the two seals 44 and 46 against each other, under the influence of the slide fasteners 48 and 50, provides a water-proof seal. Water-proofing need not be provided by the slide fasteners 48 and 50.

FIG. 6 shows a lining 52 adjacent the seals 44 and 46 to receive inner fastener 48. Reinforcing strips 54 are also shown to reinforce the lining 52 where it bends.

An important advantage of the neck seal of the present invention is shown in FIG. 2. The strap 22 may be tightened to compress the foam 20 to ensure that it is a good fit around the neck of the wearer. The foam 20 conforms to the neck of the wearer. Any unevenness introduced into the foam by compression is absorbed by the outer surface of the foam which distorts as shown at 56 but this distortion has no effect on the seal nor on the fit of the seal around the neck. Of course, the material of the neck band 18 also distorts so that the distortion is essentially external to the suit.

An equally important advantage is that the suit may be worn with the neck relatively loose in conditions where there is no danger and, in particular, no prospect of immersion. If an emergency occurs then the neck seal can be rapidly tightened. In the illustrated embodiment the inclined surfaces 30 of the strap 22 and the clasp 28 slid over each other easily when the strap 22 is pulled towards the clasp 28. However, movement in the reverse direction, the loosening movement, is prevented by the flat surfaces 32 abutting each other. The strap 22 can be loosened by pivoting the clasp 28 about pivot 38 to permit disengagement of the two sets of teeth and thus loosening of the strap 22.

A further advantage over prior art suits is ease of access. The wearer can step into the immersion suit of the invention simply by loosening the slide fasteners 48 and 50 and stepping into the suit rather than the more difficult ingress provided by the prior art opening across the back of the suit, parallel to the shoulders.

The compression strap 22 may be of nylon. The illustrated system allows good sensitivity of adjustment depending on the dimensions of the teeth. However, any method of joining a strap may be used. The system widely used on ski boots, which also features the teeth shown in FIG. 2, may also be used. In those systems the buckle is longer than shown in the drawings of the present application which may be undesirable on a immersion suit. Simple hook and pile fasteners, for example, those available under the trade-mark Velcro, may be used. A prong buckle may be used to engage holes in a belt, but the lack of sensitivity of adjustment in such an arrangement renders it a less desirable choice. The great advantage of the illustrated embodiment, and the hook and pile fasteners, is rapidity of tightening and locking and good control of the tightness of fit.

We claim:

1. In an immersion suit having a neck band with a top edge, an interior surface and an exterior surface and wherein said neckband fits around a neck and a seal at the neck the improvement comprising:

a thick band of closed cell foam on the interior of the neck band to contact the neck of a wearer of the suit; and means to compress the neck band and the closed cell foam around the neck of the wearer.

2. An immersion suit as claimed in claim 1 in which the suit has an opening in the front extending to the top edge of the neck band to allow ingress into, and egress from, the suit.

3. An immersion suit as claimed in claim 1 in which the foam is formed as a single piece adhered to the interior surface of the neck band and having mitred ends to engage each other when the neck band is compressed.

4. An immersion suit as claimed in claim 1 in which the foam is a PVC foam.

5. An immersion suit as claimed in claim 1 in which the means to compress the neck band and the closed cell foam around the neck of the wearer comprises a releasable compression strap on the exterior of the neck band.

6. An immersion suit as claimed in claim 2 further including a closed cell foam seal extending the length of the opening in the front of the suit and wherein the suit has an inner surface.

7. An immersion suit as claimed in claim 6 in which the seal in the front of the suit comprises two pieces of closed cell foam each having a top end, one piece extending down each side of the opening, wherein the pieces are adhered to the inner surface of the suit and, at their top ends, to the neck band and wherein the seal members have mitred edges to ensure mating of the edges, and thus sealing, when the suit is closed.

8. An immersion suit as claimed in claim 7 including a lining on the inner surface of the suit, adjacent the opening;

a slide fastener attached to the lining forming an inner closure for the seal;

a second slide fastener attached to the suit to form an outer closure for the seal, the slide fasteners, upon closing, acting to compress the mitred edges of the seal together.

* * * * *